US009945109B1

(12) United States Patent
White

(10) Patent No.: US 9,945,109 B1
(45) Date of Patent: Apr. 17, 2018

(54) DEVICE FOR USE WITH TOILET PLUNGER

(71) Applicant: Scott L. White, Claremore, OK (US)

(72) Inventor: Scott L. White, Claremore, OK (US)

(73) Assignee: Scott White, Claremore, OK (US)

( * ) Notice: Subject to any disclaimer, the term of this patent is extended or adjusted under 35 U.S.C. 154(b) by 192 days.

(21) Appl. No.: 14/797,451

(22) Filed: Jul. 13, 2015

Related U.S. Application Data

(60) Provisional application No. 62/047,293, filed on Sep. 8, 2014.

(51) Int. Cl.
*E03C 1/308* (2006.01)

(52) U.S. Cl.
CPC ..... *E03C 1/308* (2013.01)

(58) Field of Classification Search
CPC ..... E03C 1/308
USPC ..... 4/255.11
See application file for complete search history.

(56) References Cited

U.S. PATENT DOCUMENTS

| | | | | |
|---|---|---|---|---|
| 3,934,280 | A | 1/1976 | Tancredi | |
| 6,510,860 | B2 | 1/2003 | Kihs | |
| 7,062,799 | B2 | 6/2006 | Walsh | |
| 7,089,605 | B2 | 8/2006 | Jiang | |
| 7,124,450 | B2 * | 10/2006 | Davidson | E03D 9/00 4/255.11 |
| 7,213,273 | B2 | 5/2007 | Wang | |
| D574,116 | S | 7/2008 | Yang et al. | |
| 7,861,858 | B2 * | 1/2011 | Wang | A47K 17/00 206/15.3 |
| 7,962,974 | B2 | 6/2011 | Lanier | |
| 8,127,402 | B2 | 3/2012 | Overgaard | |

* cited by examiner

*Primary Examiner* — Tuan N Nguyen

(57) ABSTRACT

A hollow device that surrounds a toilet plunger to maintain contact between the plunger and the toilet bowl as the plunger is moved upward and downward within the device to unplug a toilet. The device has a bottom area for engaging the head of the plunger and a main body on an upper end of the device to grasp in order to apply downward pressure on the device and on the head of the plunger. The device is hollow from its upper end to its lower end so that it can be inserted over the head and handle of a toilet plunger.

6 Claims, 2 Drawing Sheets

DEVICE FOR USE WITH TOILET PLUNGER

CROSS-REFERENCE TO RELATED APPLICATIONS

The present application claims priority to U.S. Provisional Patent Application Ser. No. 62/047,292 filed on Sep. 8, 2014 for the invention entitled Device for Use with Toilet Plunger.

BACKGROUND OF THE INVENTION

1. Field of the Invention

The present invention relates to a device that fits over a toilet plunger and provides a means of applying downward pressure on the head of the plunger as the plunger handle is moved upward and downward. The purpose of the device is to insure a tight connection between the plunger head and the toilet bowl on the upward stroke of the plunger, thereby creating suction within the toilet.

2. Description of the Related Art

A toilet plunger works by engaging a toilet bowl in such a manner that the head of the plunger fits over the opening in the bottom of the bowl. Once the plunger is thus engaged, the handle of the plunger is pushed downward to force the liquid that is in the bowl downward into the bottom opening, thereby causing the pressurized liquid to unplug a plugged up toilet. The plunger often will not unplug the toilet with a single downward thrust of the plunger and it is then necessary to lift the handle of the plunger upward slightly to cause suction on the bottom opening, and then again pushing the plunger downward again and repeating this upward and downward movement repeatedly until the toilet becomes unplugged.

One of the problems associated with use of a toilet plunger is that a tight seal is hard to maintain between the toilet bowl and the head of the plunger as the plunger handle is pulled upward in the process of using the plunger. The present invention addresses this problem by providing a device that surrounds the plunger and has a bottom area for engaging and applying downward pressure on the head of the plunger to maintain adequate contact between the plunger and the toilet bowl and the device has a handle that allows the user to exert downward pressure on the device as the handle of the plunger is moved upward and downward within the device.

SUMMARY OF THE INVENTION

The present invention is a hollow device that surrounds a toilet plunger and has a bottom area for engaging and applying downward pressure on the head of the plunger to maintain adequate contact between the plunger and the toilet bowl as the plunger is employed to unplug a toilet. The device has a handle that allows the user to exert downward pressure on the device as the handle of the plunger is moved upward and downward within the device. The device preferably is provided with an open channel that extends from the upper end of the device to the lower end of the device and provides a means of inserting the device over a head and handle of a toilet plunger.

DETAILED DESCRIPTION OF THE PREFERRED EMBODIMENT

Figure 1:
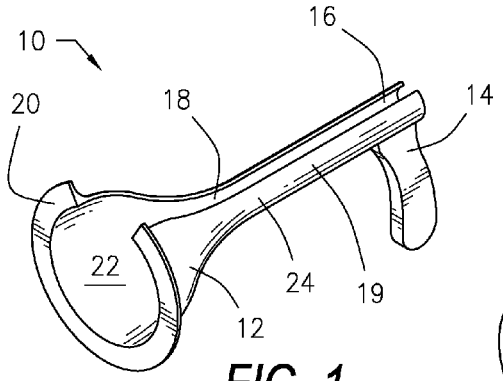
FIG. 1 is perspective view of a device for use with a toilet plunger that is constructed in accordance with a preferred embodiment of the present invention.
Figure 2:
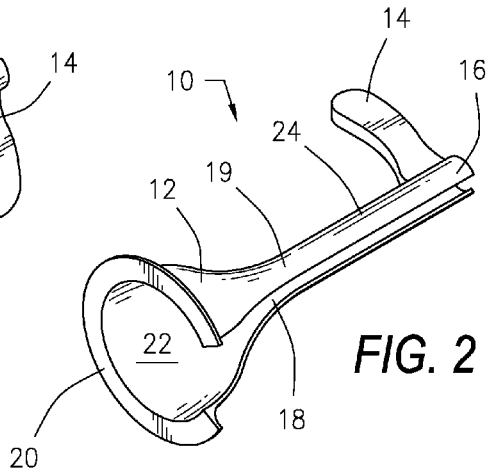
FIG. 2 is a perspective view of the device of FIG. 1 shown turned to a different orientation.
Figure 3:
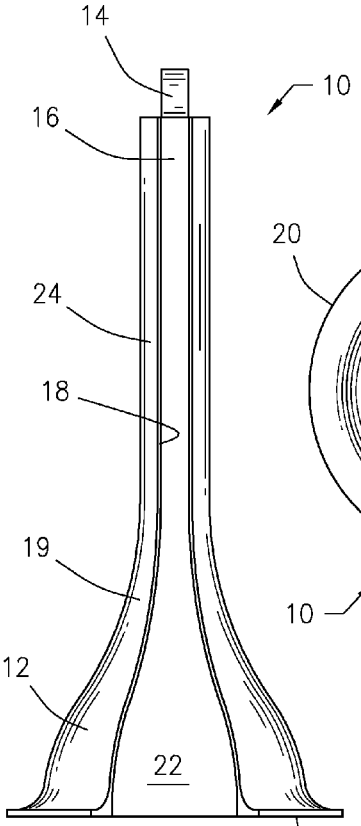
FIG. 3 is a front view of the device of FIGS. 1 and 2.
Figure 4:
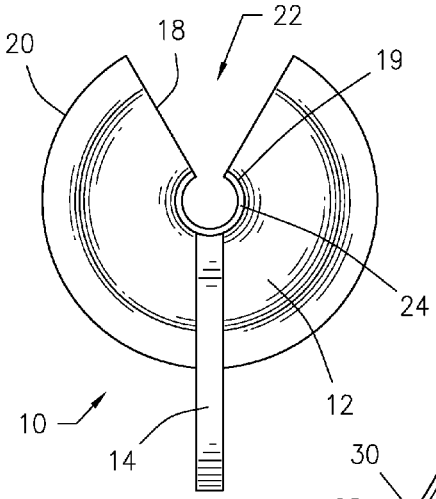
FIG. 4 is a top plan view of the device of FIG. 3.
Figure 5:
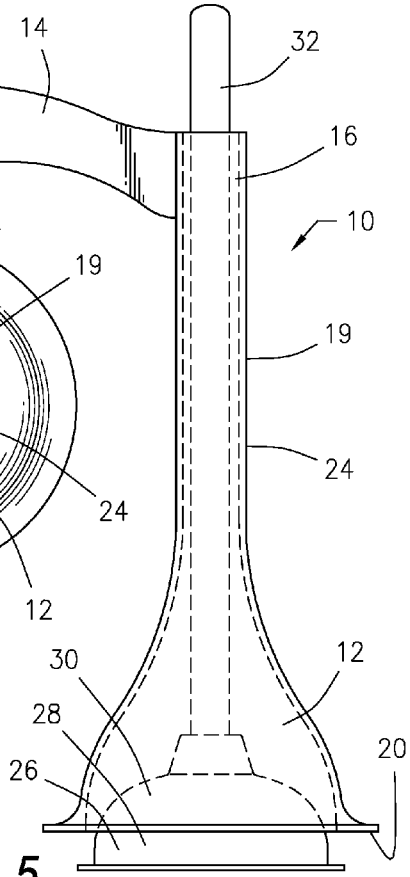
FIG. 5 is left side view of the device of FIG. 3 shown in association with a toilet plunger.

Referring now to the drawings and initially to FIGS. 1-5, there is shown a device 10 for use with a toilet plunger 26 that is constructed in accordance with a preferred embodiment of the present invention.

The device 10 is hollow and has a bottom area 12 that is shaped like an inverted cone for surrounding a head 28 of a toilet plunger 26. A lower end 20 of the device 10 is a smooth, semi-circular surface for engaging and applying downward pressure on a top 30 of the head 28 of a toilet plunger 26 to maintain adequate contact between the plunger 26 and a toilet bowl (not illustrated) as the plunger 26 is moved upward and downward while the plunger 26 is being employed to unplug a toilet.

The device 10 has a handle 14 extending outward from a main body 24 of the device 10. The handle 14 is located on an upper end 16 of device 10 and allows the user to exert downward pressure on the device 10 as a handle 32 of the toilet plunger 26 is pulled upward and pushed downward within the device 10.

The device 10 is provided with an open channel 18 in a wall 19 of the device 10 so that the open channel 18 extends from the upper end 16 of the device 10 to the opposite lower end 20 of the device 10. The channel 18 communicates with an open interior 22 of the device 10 that is designed and shaped to fit over the top 30 of a head 28 of a toilet plunger 26. The channel 18 admits a handle 32 of a toilet plunger 26 into the open interior 22 of the device 10. The channel 18 provides a means of inserting the device 10 over the head 28 and handle 32 of the toilet plunger 26 and also a means of removing the device 10 from the toilet plunger 26 once the plunger 26 has been used to unplug a toilet.

Because the device 10 fits on top 30 of the head 28 of the plunger 26, it may be stored on the plunger 26 when the plunger 26 is not in use.

Referring now to FIGS. 6-9, there is illustrated an alternate embodiment device 10A for use with a toilet plunger 26. This alternate embodiment device 10A is hollow and has a hollow bottom area 12A that is shaped like an inverted cone for surrounding a head 28 of a toilet plunger 26. A hollow lower end 20A of the alternate device 10A has a smooth, circular surface for engaging and applying downward pressure on a top 30 of the head 28 of a toilet plunger 26 to maintain adequate contact between the plunger 26 and a toilet bowl as the plunger 26 is moved upward and downward while the plunger 26 is being employed to unplug a toilet.

The alternate device 10A has a hollow main body 24A that is continuous with the hollow bottom area 12A from an upper end 16A of the alternate device 10A to the opposite lower end 20A of the alternate device 10A forming an open interior 22A within the alternate device 10A that is open at the upper end 16A and at the lower end 20A. This allows the handle 32 of a plunger 26 to be received within the hollow main body 24A and allows the top 30 of the head 28 of the plunger 26 to be received in or at least be covered by the lower end 20A of the alternate device 10A.

The bottom area 12A is provided with one or more openings 33A extending therethrough to allow liquids to escape from between the head 28 of the toilet plunger 26 and the bottom area 12A so as to prevent liquids from being forced upward within the main body 24A of the alternate device 10A when the plunger 26 is being used.

Figure 9:
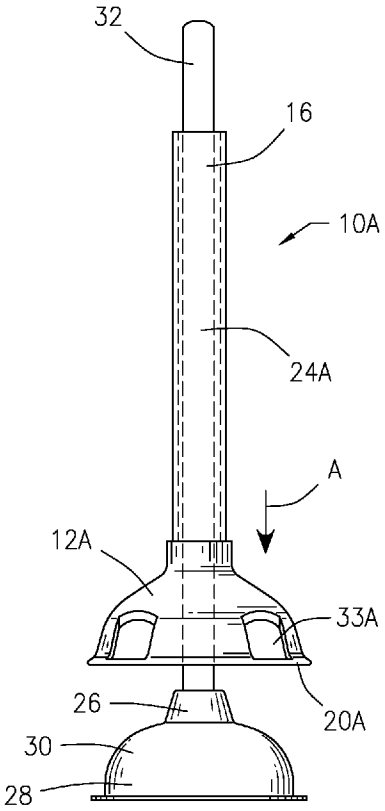
FIG. 9 is a side view of the alternate embodiment device of FIG. 7 shown being inserted over a toilet plunger.
Figure 6:
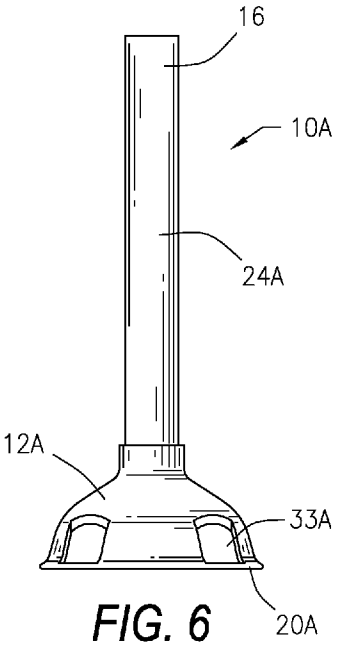
FIG. 6 is a side view of an alternate embodiment device for use with a toilet plunger.
Figure 7:
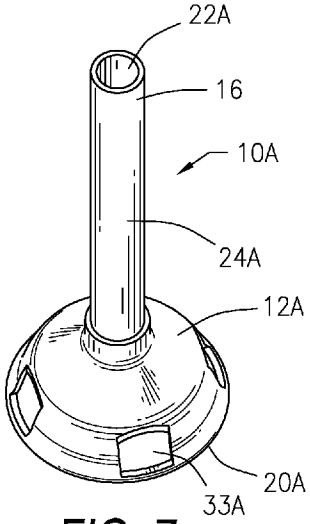
FIG. 7 is a perspective view of the alternate embodiment device of FIG. 6.
Figure 8:
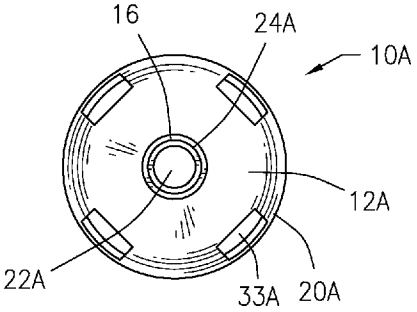
FIG. 8 is a top plan view of the alternate embodiment device of FIG. 7.

The alternate device 10A is shown in FIG. 9 being placed over the plunger 26 and then pushed downward, as indicated by Arrow A. The main body 24A of the alternate device 10A can be gripped by the user and allows the user to exert downward pressure on the alternate device 10A as the handle 32 of the toilet plunger 26 is pulled upward and pushed downward within the alternate device 10A.

The hollow main body 24A and the hollow bottom area 12A provide a means of inserting the alternate device 10A over the head 28 and handle 32 of the toilet plunger 26 and also a means of removing the alternate device 10A from the toilet plunger 26 once the plunger 26 has been used to unplug a toilet.

Because the alternate device 10A fits on top 30 of the head 28 of the plunger 26, it may be stored on the plunger 26 when the plunger 26 is not in use.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A device for use with a toilet plunger having a handle and a semi-circular plunger head comprising:

a hollow cylindrical main body for surrounding the handle of the toilet plunger, the main body having an open lower end and an open upper end, the main body being rigid to allow the main body to exert downward pressure on the semi-circular plunger head, and a hollow bottom area connecting to the lower end of the main body forming a continuous open interior, wherein the hollow bottom area formed in the shape of an inverted cone having a semi-circular surface for surrounding the semi-circular plunger head when the toilet plunger is inserted through the hollow bottom area and main body, and wherein the hollow bottom area is sized so that it is slightly smaller in diameter than the shape of the semi-circular plunger head for engaging and applying downward pressure on the semi-circular plunger head for maintaining contact between the plunger and a toilet bowl as the plunger is being used to unclog a clogged toilet.

2. The device according to claim 1 wherein the hollow bottom area has a lower end provided with at least one opening extending there through to allow liquid to escape from between the lower end of the main body and a head of a toilet plunger.

3. The device according to claim 2 further comprising:

the main body provided with a continuous open channel that extends from a lower end of the hollow bottom area to the upper end of the main body.

4. The device according to claim 3 further comprising: a handle attached to and extending outward from the upper end of the main body.

5. The device according to claim 1 further comprising:

the main body provided with a continuous open channel that extends from a lower end of the hollow bottom area to the upper end of the main body.

6. The device according to claim 5 further comprising: a handle attached to and extending outward from the upper end of the main body.

* * * * *